US009261272B2

(12) United States Patent
McConnell

(10) Patent No.: US 9,261,272 B2
(45) Date of Patent: Feb. 16, 2016

(54) MARINE LIGHT FIXTURE

(71) Applicant: GreenLYT LLC, Shoreline, WA (US)

(72) Inventor: Whyle Ian McConnell, Shoreline, WA (US)

(73) Assignee: GREENLYT LLC, Shoreline, WA (US)

( * ) Notice: Subject to any disclaimer, the term of this patent is extended or adjusted under 35 U.S.C. 154(b) by 296 days.

(21) Appl. No.: 13/654,112

(22) Filed: Oct. 17, 2012

(65) Prior Publication Data

US 2013/0100661 A1 Apr. 25, 2013

Related U.S. Application Data

(60) Provisional application No. 61/551,296, filed on Oct. 25, 2011.

(51) Int. Cl.

| | |
|---|---|
| ***F21V 7/04*** | (2006.01) |
| ***F21V 31/00*** | (2006.01) |
| ***F21V 14/04*** | (2006.01) |
| *F21W 101/04* | (2006.01) |
| *F21Y 101/02* | (2006.01) |
| *F21Y 105/00* | (2006.01) |
| *B63B 45/04* | (2006.01) |

(52) U.S. Cl.

CPC ..... *F21V 31/005* (2013.01); *F21V 7/041* (2013.01); *F21V 14/04* (2013.01); *B63B 45/04* (2013.01); *F21W 2101/04* (2013.01); *F21Y 2101/02* (2013.01); *F21Y 2105/001* (2013.01)

(58) Field of Classification Search

CPC F21W 2101/04; F21V 14/006; F21V 31/005; F21V 7/041

See application file for complete search history.

(56) References Cited

U.S. PATENT DOCUMENTS

| | | | | |
|---|---|---|---|---|
| 2009/0323337 | A1 | 12/2009 | Wang et al. | |
| 2010/0085760 | A1 | 4/2010 | Hsu et al. | |
| 2011/0204794 | A1 | 8/2011 | Beghelli | |
| 2011/0228531 | A1 * | 9/2011 | Boyer et al. | 362/235 |

FOREIGN PATENT DOCUMENTS

JP 2011-129405 A 6/2011

OTHER PUBLICATIONS

International Search Report, mailed Mar. 29, 2013, for PCT/US2012/060534, 3 pages.

Written Opinion, mailed Mar. 29, 2013, for PCT/US2012/060534, 7 pages.

* cited by examiner

*Primary Examiner* — Nimeshkumar Patel
*Assistant Examiner* — Brenitra M Lee
(74) *Attorney, Agent, or Firm* — Seed IP Law Group PLLC

(57) ABSTRACT

Configurable light fixtures are provided. The light fixture includes a housing having an opening. At least one reflector having at least a first and a second configurable throw pattern, is disposed within the housing proximate the opening. The reflector accommodates the post-manufacture installation of a number of reflective throw pattern adjustment members to provide first and second configurable throw patterns having subtended angles with the same or different values.

13 Claims, 7 Drawing Sheets

MARINE LIGHT FIXTURE

BACKGROUND

1. Technical Field

This disclosure generally relates to lighting fixtures and particularly relates to marine lighting fixtures.

2. Description of the Related Art

Lighting systems are used in a wide variety of applications and environments. Some environments may be particularly harsh. For example, marine environments may expose a lighting system to corrosion from water, to high winds, and other operational stresses.

Marine lighting systems are used on both recreational and commercial vessels. Lighting requirements vary by service, application, and user, at times requiring a floodlight able to provide broad illumination of an area and at other times requiring the precision of a spotlight able to provide focused illumination at a specific location. Limited shipboard power can restrict the size and number of lighting fixtures that can be safely accommodated. Limited shipboard real estate places a premium on the size and utility of a marine light fixture, thus the ability to physically mount multiple lighting fixtures may not exist. Due to space constraints or operational requirements, marine lighting fixtures may be mounted in unusual configurations, at times on structures not originally intended for use as a lighting stand.

In addition to inherent shipboard physical and electrical limitations, marine light fixtures must also endure harsh operating conditions including extremes of heat, moisture, and vibration. Such operational demands increase the likelihood of failure of electronics within the light fixture. Rigorous service conditions, limited availability of shipboard space and/or resources, and wide variability in user requirements place challenging demands on marine light fixtures. Thus, a configurable marine light fixture having a flexible mounting system, and acceptable water-resistance and anti-fog characteristics is desirable.

BRIEF SUMMARY

A light fixture may be summarized as including a housing having an interior separated by the housing from an exterior ambient environment, the housing having at least one opening between the interior and the exterior ambient environment; and at least one reflector at least partially received by the housing and which has a first and a second configurable throw pattern that extends outwardly from the at least one opening, the configurable throw patterns having respective ones of at least one subtended angle, the at least one reflector having a number of coupling features to selectively install, after manufacture of the light fixture, at least one reflective throw pattern adjustment member, a first one of the subtended angles of the first configurable throw pattern has a first value when the reflective throw pattern adjustment member is not installed and the first one of the subtended angles of the first configurable throw pattern has a second value after the reflective throw pattern adjustment member is installed, the second value of the first one of the subtended angles different from the first value of the first one of the subtended angles.

A first one of the subtended angles of the second configurable throw pattern may have a first value when the reflective throw pattern adjustment member is not installed and the first one of the subtended angles of the second configurable throw pattern may have a second value after the reflective throw pattern adjustment member is installed, the second value of the first one of the subtended angles different from the first value of the first one of the subtended angles. A first one of the subtended angles of the second configurable throw pattern may have a first value when the reflective throw pattern adjustment member is not installed, the first value of the first one of the subtended angles of the second configurable throw pattern approximately the same as the first value of the first one of the subtended angles of the first configurable throw pattern. The at least one reflector may include a first reflector and a second reflector mounted in a side by side relationship to the housing, and may further include a first solid state light source positioned with respect to the first reflector such that the first reflector reflects at least a portion of the light emitted by the first solid state light source in the first configurable throw pattern; and a second solid state light source positioned with respect to the second reflector such that the second reflector reflects at least a portion of the light emitted by the second solid state light source in the first configurable throw pattern. The first and the second reflector may each have at least four reflective sides which include a first pair of opposed reflective sides and a second pair of opposed reflective sides, the reflective sides of each of the first and the second pairs of reflective sides angled outwardly with respect to one another from the interior of the housing toward the exterior ambient environment. The at least one reflective throw pattern adjustment member may include at least a first and a second reflective throw pattern adjustment member and the number of coupling features may include a first pair of slots in respective ones of the first pair of opposed reflective sides of the first and second reflectors and a second pair of slots in respective ones of the first pair of opposed reflective sides of the first and second reflectors, the second pair of slots spaced laterally across the first reflector from the first pair of slots, the first and the second pair of slots sized and dimensioned to securely receive respective ones of the first and the second reflective throw pattern adjustment members. The slots in the first one of the reflective sides of the first opposed pair of reflective sides may be angled outwardly with respect to one another from the interior of the housing toward the exterior ambient environment, and the slots in the first one of the reflective sides of the second opposed pair of reflective sides may be angled outwardly with respect to one another from the interior of the housing toward the exterior ambient environment. An angle between the slots in the first one of the reflective sides of the first pair of opposed reflective sides may be different than an angle between the slots in the first one of the reflective sides of the second pair of opposed reflective sides. The at least one reflector may consist of a single reflector having four reflective sides which include a first pair of opposed reflective sides and a second pair of opposed reflective sides, the reflective sides of each of the first and the second pairs of reflective sides angled outwardly with respect to one another from the interior of the housing toward the exterior ambient environment. The at least one reflective throw pattern adjustment member may include at least a first and a second reflective throw pattern adjustment member and the number of coupling features may include a first pair of slots in the first pair of opposed reflective sides and a second pair of slots in respective ones of the first pair of opposed reflective sides, the second pair of slots spaced laterally across the first reflector from the first pair of slots, the first and the second pair of slots sized and dimensioned to securely, removably, receive respective ones of the first and the second reflective throw pattern adjustment members. The light fixture may further include at least one keyed rotary adjuster coupled to the housing to rotate the housing about at least one axis, the keyed rotary adjuster including a central cavity to accept the insertion of a shaft, surrounded by a plurality of peripheral cavities to accept the insertion of a key member to fix the housing at a fixed angle of rotation about the shaft. The housing may include an exterior surface and the at least one keyed rotary adjuster may be affixed to the exterior surface of the housing. The housing may include an interior surface and the at least one keyed rotary adjuster may be at least partially affixed to the interior surface of the housing and accessible from outside of the housing. The light fixture may further include a transparent member received into the opening of the housing, the transparent member coupled at least in part to the housing by a thermally conductive sealant material disposed at least partially between the transparent member and the housing to seal the opening and conductively transfer heat between the housing and the transparent member. The light fixture may further include a heat transfer member at least partially coupled to the housing at least in part by a thermally conductive material disposed at least partially between the heat transfer member and the housing to conductively transfer heat from the housing to the heat transfer member.

A light fixture may be summarized as including a housing having an interior separated by the housing from an exterior ambient environment, the housing having at least one opening between the interior and the exterior ambient environment; at least one reflector at least partially received by the housing and which has a first and a second configurable throw pattern that extends outwardly from the at least one opening, the configurable throw patterns having respective ones of at least one subtended angle, the at least one reflector having a number of coupling features to selectively install, after manufacture of the light fixture, at least one reflective throw pattern adjustment member, a first one of the subtended angles of the configurable first throw pattern has a first value when the reflective throw pattern adjustment member is not installed and the first one of the subtended angles of the first configurable throw pattern has a second value after the reflective throw pattern adjustment member is installed, the second value of the first one of the subtended angles different from the first value of the first one of the subtended angles; a plurality of keyed rotary adjusters, coupled to the housing to rotate the housing about at least one axis, each of the plurality of keyed rotary adjusters including a central cavity to accept the insertion of a shaft, surrounded by a plurality of peripheral cavities to accept the insertion of a key member to fix the housing at an angle of rotation about the shaft; and a transparent member received into the opening of the housing, the transparent member coupled at least in part to the housing by a thermally conductive sealant material disposed at least partially between the transparent member and the housing to seal the opening and conductively transfer heat between the housing and the transparent member.

The light fixture may further include a mounting member couplable to the plurality of keyed rotary adjusters, the mounting member including: at least one shaft insertable within the central cavity of at least a portion of the plurality of keyed rotary adjusters; at least one key member insertable within at least one of the peripheral cavities of at least a portion of the plurality of keyed rotary adjusters; and at least one mounting fixture to attach the mounting member and housing to an external structure. The housing may have an exterior surface and at least a portion of the plurality of keyed rotary adjusters may be affixed to the exterior surface of the housing. The housing may have an interior surface and at least a portion of the plurality of keyed rotary adjusters may be affixed at least partially to the interior surface of the housing in a location accessible from outside the housing. The at least one reflector may include a first reflector and a second reflector mounted in a side by side relationship to the housing, and may further include a first solid state light source positioned with respect to the first reflector such that the first reflector reflects at least a portion of the light emitted by the first solid state light source in the first configurable throw pattern; and a second solid state light source positioned with respect to the second reflector such that the second reflector reflects at least a portion of the light emitted by the second solid state light source in the first configurable throw pattern.

A light fixture may be summarized as including a housing having an interior separated by the housing from an exterior ambient environment, the housing having at least one opening between the interior and the exterior ambient environment; at least two reflectors in a side-by-side tandem arrangement, the at least two reflectors at least partially received by the housing, each of the reflectors includes at least a first pair and a second pair of laterally opposed reflective sides angling outward from the reflector and extending towards the at least one opening, each of the at least two reflectors has a first and a second configurable throw pattern that extends outwardly from the reflector, each of the first and second configurable throw patterns having respective ones of at least one subtended angle; a first pair and a second pair of slots, each pair of slots symmetrically disposed on the first pair of laterally opposed reflective sides of each reflector, each pair of slots to selectively accept, after manufacture of the light fixture, at least one reflective throw pattern adjustment member, a first one of the subtended angles of the configurable first throw pattern has a first value when the at least one reflective throw pattern adjustment member is not installed and the first one of the subtended angles of the first configurable throw pattern has a second value after the at least one reflective throw pattern adjustment member is installed, the second value of the first one of the subtended angles different from the first value of the first one of the subtended angles; a plurality of keyed rotary adjusters, coupled to the housing to rotate the housing about at least one axis, each of the plurality of keyed rotary adjusters including a central cavity to accept the insertion of a shaft, surrounded by a plurality of peripheral cavities to accept the insertion of a key member to fix the housing at an angle of rotation about the shaft; a heat transfer member at least partially coupled to the housing by a thermally conductive material disposed at least partially between the heat transfer member and the housing to conductively transfer heat from the housing to the heat transfer member; and an at least partially transparent member received into the opening of the housing, the at least partially transparent member coupled at least in part to the housing by a thermally conductive sealant material to seal the opening and conductively transfer heat between the housing and the at least partially transparent member.

The light fixture may further include a first solid state light source positioned with respect to the first reflector such that the first reflector reflects at least a portion of the light emitted by the first solid state light source in the first configurable throw pattern; and a second solid state light source positioned with respect to the second reflector such that the second reflector reflects at least a portion of the light emitted by the second solid state light source in the first configurable throw pattern.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with computing systems including client and server computing systems, broadcast systems including radio and television broadcast systems, as well as networks and other communications channels have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

Figure 1B:
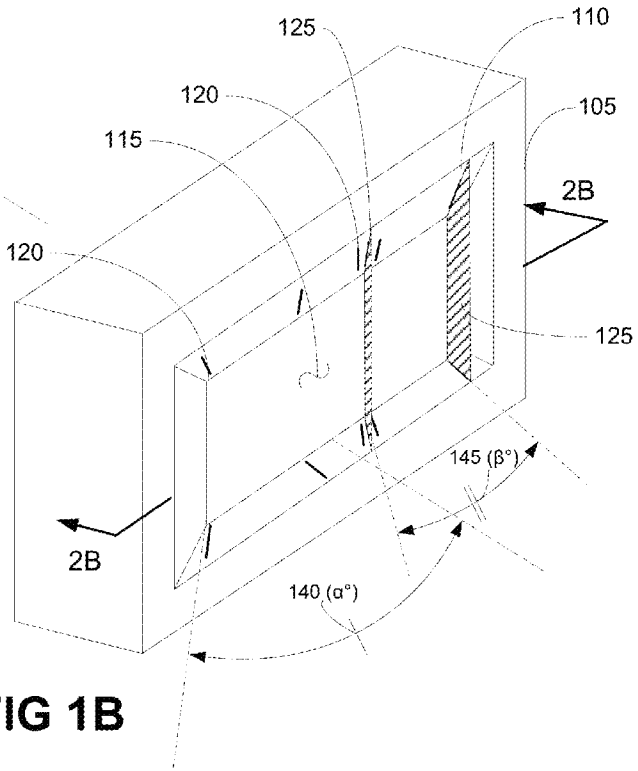
FIG. 1B is an orthogonal view of the lighting fixture depicted in FIG. 1A, including a number of reflective throw pattern adjustment members coupled to a portion of the coupling features, according to one illustrated embodiment.
Figure 1A:
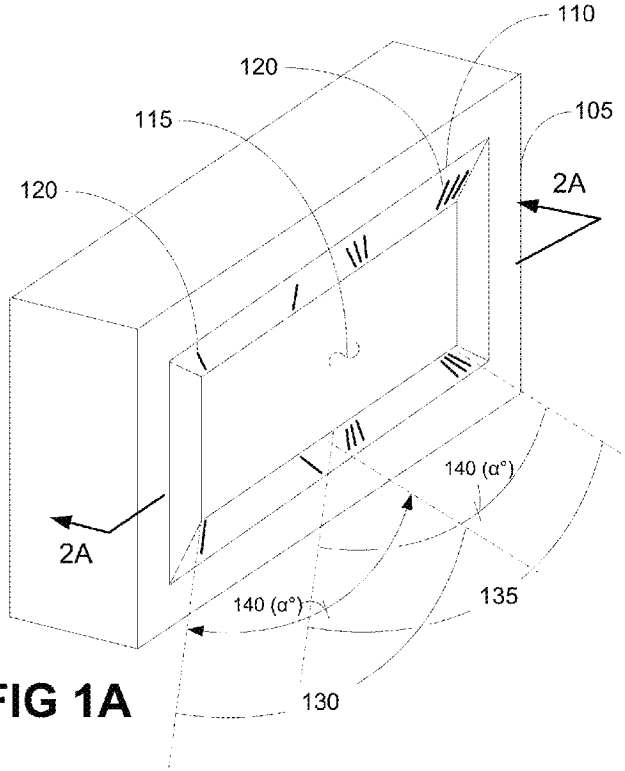
FIG. 1A is an orthogonal view of a lighting fixture including a housing and a reflector having configurable first and second throw patterns and a number of coupling features, according to one illustrated embodiment.

FIGS. 1A and 1B depict an example lighting fixture 100 including a housing 105 having at least one opening 110, and a reflector 115 mounted at least partially within an interior space of the housing 105. The reflector 115 can have any physical orientation or geometry, including shapes and configurations other than the illustrative prismatic reflector depicted in FIG. 1A. The reflector 115 provides multiple configurable throw patterns 130, 135 exiting the housing via the at least one opening 110. The multiple configurable throw patterns include at least two patterns 130, 135, and may include a greater number of throw patterns, all at least partially exiting from the at least one opening 110. The ability to generate multiple configurable throw patterns 130, 135 within a single housing provides operational flexibility, for instance the ability to generate two differing throw patterns such as a broad-beam floodlight and a narrow-beam spotlight using the same light fixture 100.

A number of coupling features 120 are disposed about the reflector 115. The coupling features 120 permit the temporary or permanent attachment of at least one reflective throw pattern adjustment member 125, each coupled to at least one of the coupling features 120 disposed about the reflector 115. A variety of physical shapes and configurations can be used to couple the reflective throw pattern adjustment members 125 to the coupling features 120. In some instances, the coupling features 120 can include a plurality of slots disposed about the reflector 115 and can include a complimentary tab or edge insertable into one of the slots forming the coupling features 120. In other instances, each of the reflective throw pattern adjustment members 125, may be sized and dimensioned to result in an interference fit. In yet other instances, the coupling features 120 can include a plurality of slots disposed about the reflector 115 to which each of the reflective throw pattern adjustment members 125 can be permanently affixed, for example, through the use of an adhesive or similar material.

The light fixture in FIG. 1A is depicted without the reflective throw pattern adjustment members 125 coupled to the coupling features 120. In the absence of the reflective throw pattern adjustment members 125, the lighting fixture will provide a throw pattern based upon the geometry of the reflector 115 and the size, location and number of light sources disposed proximate the reflector 115. In some instances, for example, where two similarly sized and placed light sources are proximate a symmetric or uniform reflector 115, the light fixture depicted in FIG. 1A provides two similarly configured throw patterns 130, 135, each having a similar subtended angle 140 with a first value a°.

In other instances, for example, as depicted in FIG. 1B, one or more reflective throw pattern adjustment members 125 may be disposed proximate the reflector 115 to alter or change the geometry or reflective characteristics of all or a portion of the reflector 115. For example, two throw pattern adjustment members 125 are shown coupled to the light fixture 100 in FIG. 1B. The presence of the throw pattern adjustment members 125 alters the geometry of the reflector 115 such that even with similarly sized and placed light sources proximate the reflector 115, each of the throw patterns 130, 135 has a different subtended angle. The first throw pattern 130 has a subtended angle 140 with a first value of $\alpha°$, while the second throw pattern 135 has a reduced subtended angle 145 with a second value of $\beta°$.

The reflector 115 may provide more than two different subtended angles 140, 145, for example, through the use of a plurality of coupling features 120 disposed at differing angles measured with respect to the light source, the reflector 115, or both the light source and the reflector 115. An example may be the use of slotted coupling features 120 disposed at three different angles, such as 60°, 70°, and 80°, measured with respect to the light source or the reflector 115.

The housing 105 can include a metallic or non-metallic structure capable of providing support and physical protection of the reflector 115. Although only a single opening 110 is depicted in FIGS. 1A and 1B, any number of openings 110 can be symmetrically or asymmetrically arranged on or about the housing 105. For example, a second opening may be present opposite the opening 110 to facilitate the installation of the reflector 115. Other smaller openings may be present in the housing 105, for example, to provide access to one or more mounting or support devices intended to mount the lighting fixture 100 to a surface or other structure.

The housing 105 may have any shape, size, or configuration dependent at least in part upon the type of the reflector 115, light source, power supply and controller placed at least partially within the housing. When the lighting fixture 100 is intended for use in a shipboard environment where space is at a premium, smaller housings, for example, a housing measuring about 12.25 inches wide by about 7.50 inches high, by about 3.6 inches deep may be used.

To provide adequate strength and corrosion resistance, particularly in a marine environment, the housing 105 may be fabricated in whole or in part from aluminum or an aluminum alloy such as marine grade aluminum alloys 5083 or 6061. In some embodiments, the housing 105 may be fabricated from sheet aluminum that is cut, bent and assembled to form the housing 105. In other embodiments, the housing 105 may be fabricated from individual pieces of ¼" to ½" thick aluminum plate that are welded or otherwise chemically or thermally fused together to provide the housing 105. In other embodiments, the housing 105 may be fabricated using an aluminum shape, for example, a square tube, which is cut, bent, and assembled to form the housing 105. To provide additional structural strength to the housing 105 one or more internal or external frames, support members, gussets, or the like may be used.

The use of various heat producing elements such as power supplies, lighting controllers, and light sources within the housing 105 creates heat within the housing 105. The ability to remove or convey this heat to the exterior ambient environment about the housing 105 may assist in limiting or otherwise controlling the heat within the housing 105 thereby improving the performance or extending the life of the light sources and/or electronics. The use of thermally conductive metallic or non-metallic materials, such as the aforementioned aluminum 5083 or 6161 alloys may facilitate convective heat transfer from within the housing 105 to the surrounding ambient environment.

A surface treatment may be applied to the interior surfaces, exterior surfaces, or both interior and exterior surfaces of the housing 105. Surface treatments may be applied to the housing 105 for decorative purposes, to improve corrosion resistance, to improve thermal performance, or any combination thereof. Surface treatments may include the application of surface coatings such as powder coatings; chemical coatings such as anodization; or metallic coatings such as electroless nickel plating.

The at least one opening 110 in the housing 105, although depicted as a rectangular opening in FIGS. 1A and 1B, may be of any size or shape necessary to accommodate the first and second configurable throw patterns 130, 135 and the reflector 115. For example, if a dished or parabolic reflector 115 is used, the at least one opening 110 can have a circular, oval, or rounded corner rectangular configuration. The opening 110 can have any physical dimensions, limited only by the physical size of the housing 105 and the size and shape of the at least first and second configurable throw patterns 130, 135 that pass through the opening 110. In some embodiments, one or more crossbars across the opening 110 may be employed to provide structural support or strength for the housing 105. When the lighting fixture 100 is intended for use in a shipboard environment where space is at a premium, smaller housings 105 may limit the size of the opening 110, for example, limiting the opening size to about 10.50 inches wide by about 2.50 inches high. A structural element, for example, a recess, a flange, or similar detent to facilitate the attachment of a member partially or completely covering the opening 110 can extend about all or a portion of the interior or exterior perimeter of the opening 110.

In some embodiments, a rectangular, angled reflector 115 as depicted in FIGS. 1A and 1B may be used. The rectangular, angled reflector 115 may incorporate a relatively flat back plane with at least four outwardly angled sides. Although a rectangular, angled reflector 115 is depicted in FIGS. 1A and 1B, the reflector 115 may have any size, shape, or geometry necessary to achieve at least the first and second configurable throw patterns 130, 135. The first and second configurable throw patterns 130, 135 are independently configurable such that each provides at least two subtended angles 140, 145 dependent upon the size and number of any reflective throw pattern adjustment members 125 coupled to the coupling features 120 disposed about the reflector 115.

The reflector 115 may incorporate metallic, non-metallic, or any combination of metallic and non-metallic reflective surfaces to achieve at least the first and second configurable throw patterns 130, 135. The materials used to provide the reflective surfaces of reflector 115 can be surface treated or otherwise coated to improve performance, reflectivity, durability, or any combination thereof. For example, anodized reflective aluminum may be used to provide a resilient, durable, reflective surface on all or a portion of the reflector 115.

The reflector 115 may be temporarily or permanently attached or otherwise affixed to the housing 105 proximate all or a portion of the opening 110. In some instances, mechanical fasteners such as screws, ¼-turn (e.g., Dzus) fasteners, or similar threaded devices may be used to permanently or temporarily attach the reflector 115 to the housing 105. In other instances, chemical adhesives such as epoxies or similar compounds may be used to permanently or temporarily attach the reflector 115 to the housing 105. A sealant such as a silicone sealant may be disposed about all or a portion of the reflector 115 to minimize the likelihood of fluid intrusion into the housing 105. In some embodiments, a thermally conductive fastener, sealant, material, or any combination thereof may be used to thermally couple or otherwise attach the reflector 115 to the housing 105. Thermally coupling the reflector 115 to the housing 105 can permit conductive heat transfer from the reflector 115 to the housing 105, thereby minimizing the temperature rise experienced by the reflector 115 during operation of the light fixture 100.

A number of coupling features 120 permitting the temporary or permanent attachment of at least one reflective throw pattern adjustment member 125 are disposed about the reflector 115. Disposing the coupling features 120 in locations accessible after manufacture of the light fixture 100, provides post-manufacture flexibility in tailoring the configuration of the first and second configurable throw patterns 130, 135, for example, by providing a combination of wide and narrow beam throw patterns 130, 135. Although depicted about the perimeter of the reflector 115 in FIGS. 1A and 1B, all or a portion of the coupling features 120 may be physically located in whole or in part on the reflector 115, on the housing 105, or any combination of the reflector 115 and the housing 105.

Where the reflector 115 includes a number of angled sides such as depicted in FIGS. 1A and 1B, at least a portion of the coupling features 120 may be placed or otherwise disposed on or about the angled sides of the reflector 115. Although the coupling features 120 are depicted as a series of slots in FIGS. 1A and 1B, any exposed, surface, or recessed coupling feature 120 enabling the attachment of the at least one reflective throw pattern adjustment member 125 may be used either alone or in conjunction with other coupling features 120. For example, the coupling features 120 can include any number of recesses, cavities, pockets, detents, appurtenances, or combinations thereof.

In some instances, multiple coupling features 120 may be disposed about all or a portion of the reflector 115. The multiple coupling features 120 can include, for example, a plurality of slots disposed at differing angles measured with respect to the visible light source or reflector 115 as depicted in FIGS. 1A and 1B. Making the coupling features 120 accessible after manufacture permits flexibility in user configuration of the light fixture 100 by allowing the coupling of the at least one reflective throw pattern adjustment member 125 in different locations as needed to provide first and second configurable throw patterns 130, 135 having the same or different subtended angles 140, 145.

The reflective throw pattern adjustment members 125 can include any structure having a partially or completely reflective surface capable of affecting the physical or optical characteristics of the first and second configurable throw patterns 130, 135. The throw pattern adjustment members 125 may be installed either at the time of manufacture or subsequent to the manufacture of the light fixture 100. The ability to couple the reflective throw pattern adjustment members 125 post-manufacture of the light fixture 100 provides the opportunity to customize the configuration of the light fixture, enabling each of the throw patterns 130, 135 to have the same or different subtended angles 140, 145. For example, the first configurable throw pattern 130 with no reflective throw pattern adjustment members 125 installed has a subtended angle 140 with a first value of $\alpha°$ corresponding to a floodlight, while the second configurable throw pattern 135 with two reflective throw pattern adjustment members 125 has a subtended angle 145 with a second value of $\beta°$ corresponding to a spotlight.

The reflective throw pattern adjustment members 125 may include any metallic, non-metallic, or combination of metallic and non-metallic materials capable of providing a reflective surface suitable for adjusting the subtended angle 140 of the first or second configurable throw patterns. All or a portion of the reflective throw pattern adjustment members 125 can have any shape, size or configuration necessary to engage with or attach to the coupling features 120—non-limiting examples include: blade shaped members, airfoil shaped members, and triangular members.

In some instances, the coupling features 120 may be disposed at a fixed angle with respect to the face of the visible light source or reflector 115. Where the coupling features 120 are disposed at a fixed angle, all or a portion of the reflective throw pattern adjustment members 125 may be offset or disposed at an angle with respect to the coupling features 120 to provide variable throw patterns each having various different subtended angles.

Installing the reflective throw pattern adjustment members 125 after manufacture of the light fixture 100 includes engaging or coupling a feature on the reflective throw pattern adjustment members 125 with the appropriate coupling feature 120. In some instances, the coupling of the reflective throw pattern adjustment members 125 with the appropriate coupling feature 120 may include sliding the adjustment member 125 into a slotted coupling feature 120. In other instances, the coupling of the adjustment member 125 may include flexing the adjustment member 125 such that tabs on the ends of the adjustment member 125 "spring" into a slotted coupling feature 120. In yet other instances, the coupling of the adjustment member 125 may include the installation of one or more fasteners or adhesives either on the face or the reverse side of the reflector 115 to secure the adjustment member 125 in place.

Figure 2A:
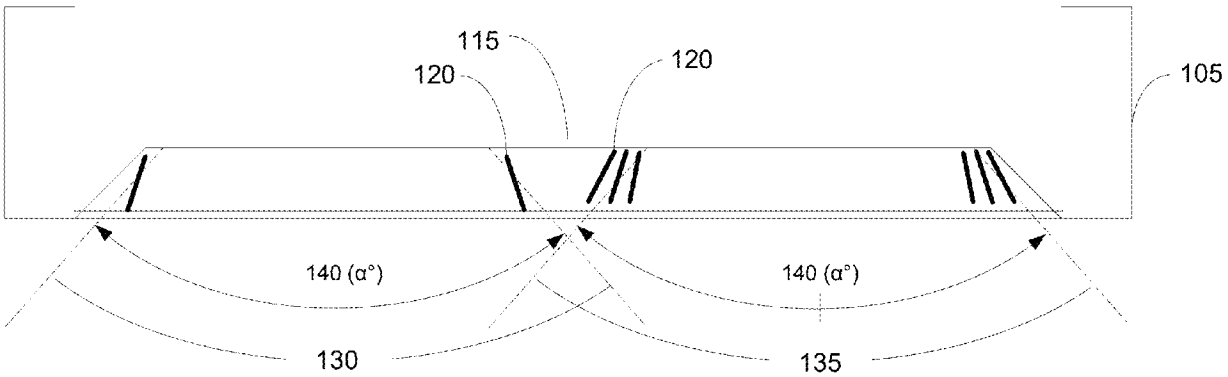
FIG. 2A is a plan view of two broad beam throw patterns provided by the lighting fixture depicted in FIG. 1A, according to one illustrated embodiment.
Figure 2B:
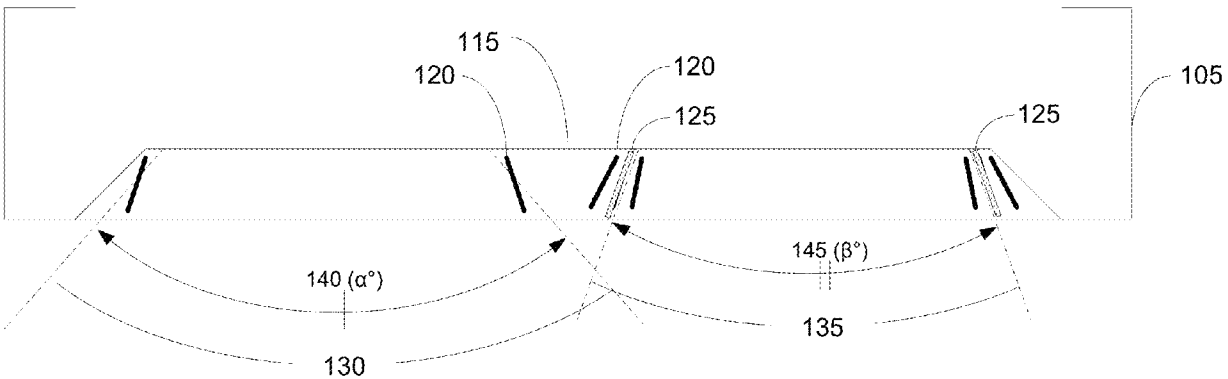
FIG. 2B is a plan view of a single broad beam throw pattern and a single narrow beam throw pattern provided by the lighting fixture depicted in FIG. 1B, according to one illustrated embodiment.

FIG. 2A shows a dual broad beam throw pattern. FIG. 2B shows a single broad beam and a single narrow beam throw pattern. The throw patterns depicted in FIGS. 2A and 2B correspond to the light fixture configurations depicted in FIGS. 1A and 1B, respectively.

The dual broad beam throw pattern in FIG. 2A depicts a configuration having no installed reflective throw pattern adjustment members 125. In such a configuration, the first configurable throw pattern 130 and the second configurable throw pattern 135 will be similar. With comparably positioned and illuminated light sources and a symmetric reflector 115 design, the subtended angle 140 of each the first throw pattern 130 and the second throw pattern 135 will be similar, having a first value of α° in the example depicted in FIG. 2A. Although not depicted in FIG. 2A, an asymmetric reflector 115 design may cause the first configurable throw pattern 130 and the second throw pattern 135 to have differing subtended angles.

The single broad beam and a single narrow beam throw pattern in FIG. 2B depicts a configuration where reflective throw pattern adjustment members 125 have been coupled to the portion of the reflector 115 providing the second throw pattern 135. The first configurable throw pattern 130, unaffected by the installation of the reflective throw pattern adjustment members 125, retains a broad throw pattern with a relatively wide subtended angle 140 having a first value of α°. The installation of the reflective throw pattern adjustment members 125 in the second configurable throw pattern 135 however, reduces the subtended angle 145 to provide a tighter, more focused throw pattern having a second value of β°, where α° and β° are different angles.

Although illustrated using a reflector 115 having only first and second configurable throw patterns 130, 135, a reflector 115 having any number of throw patterns may be similarly employed, for example, by providing an appropriate number of coupling features 120 for each of the throw patterns provided by the reflector 115. Where the reflector 115 provides three or more throw patterns, each throw pattern may be independently configured after manufacture of the light fixture 100 to have the same or different subtended angles dependent upon the number and location of reflective throw pattern adjustment members 125 coupled to the coupling features 120.

Figure 3B:
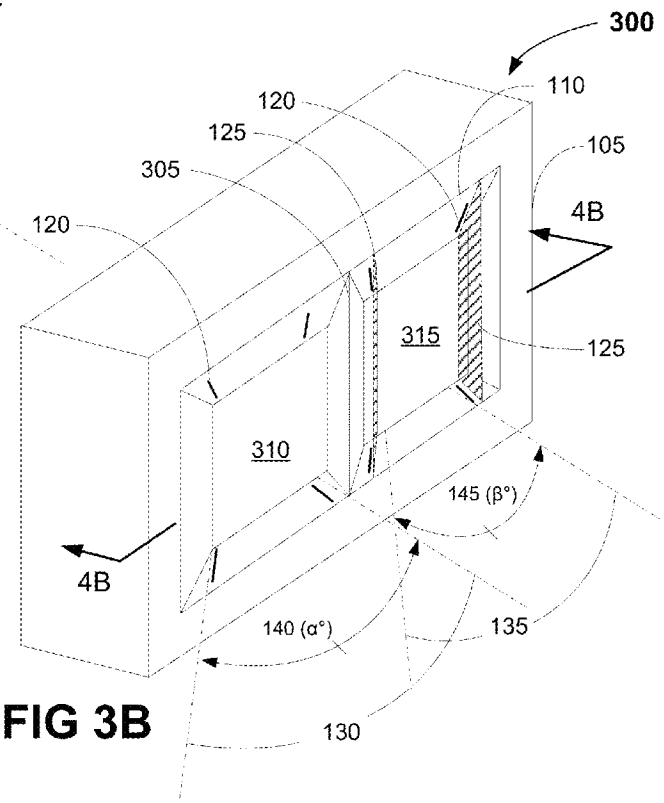
FIG. 3B is an orthogonal view of the lighting fixture depicted in FIG. 3A including a number of reflective throw pattern adjustment members coupled to a portion of the coupling features in one of the two side-by-side reflectors, according to one illustrated embodiment.
Figure 3A:
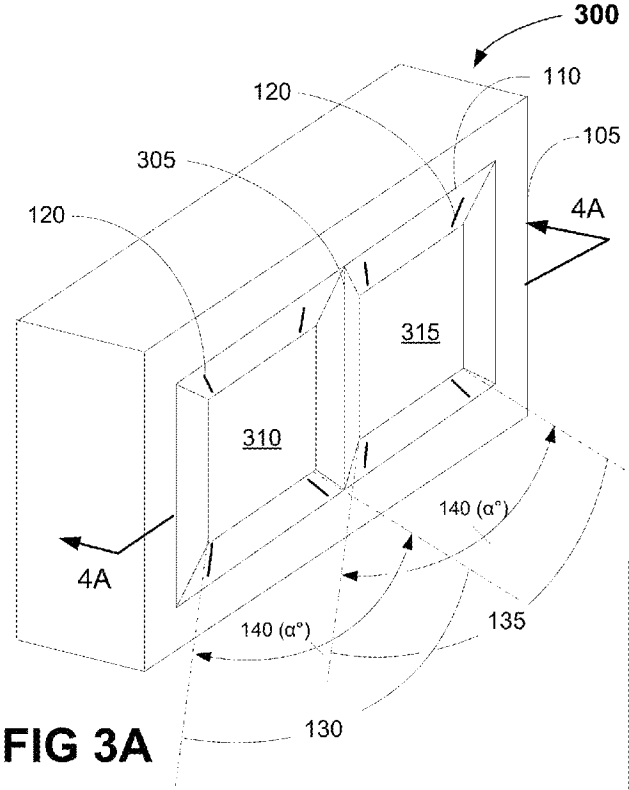
FIG. 3A is an orthogonal view of a lighting fixture including a housing and a reflector including two side-by-side reflectors, each having configurable first and second throw patterns and a number of coupling features, according to one illustrated embodiment.

FIGS. 3A and 3B show a light fixture 300 having a reflector 115 divided by a reflective member 305 to provide two side-by-side reflectors 310 and 315. Similar to the reflector 115 discussed previously, the first and second configurable throw patterns 130, 135 of each of the side by side reflectors 310, 315 are independently configurable by coupling one or more reflective throw pattern adjustment members 125 with at least a portion of the coupling features 120.

The lighting fixture 300 in FIG. 3A is depicted without reflective throw pattern adjustment members 125 to provide configurable throw patterns 130, 135 each having a similar subtended angle 140 with a first value of α°. The lighting fixture 300 depicted in FIG. 3B is depicted with reflective throw pattern adjustment members 125 proximate reflector 315 generating a second configurable throw pattern 135 having a relatively smaller subtended angle 145 with a second value of β°.

Figure 4A:
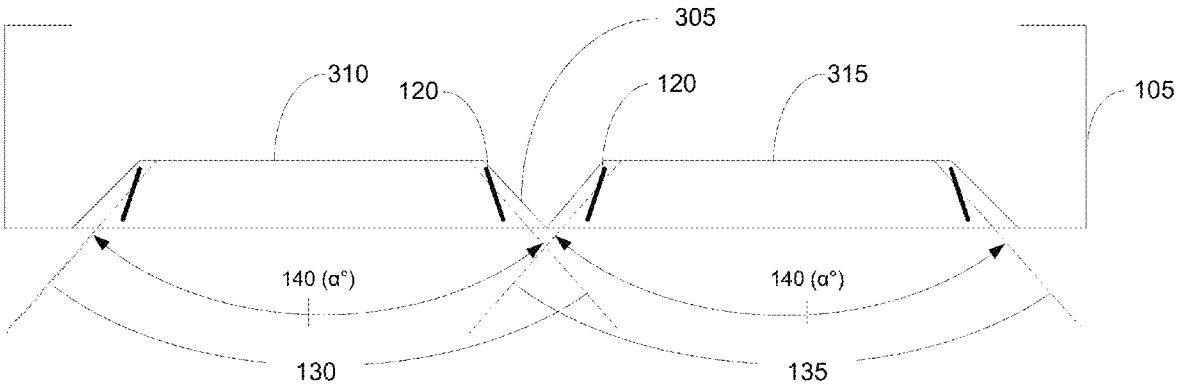
FIG. 4A is a plan view of two broad beam throw patterns provided by the lighting fixture depicted in FIG. 3A, according to one illustrated embodiment.
Figure 4B:
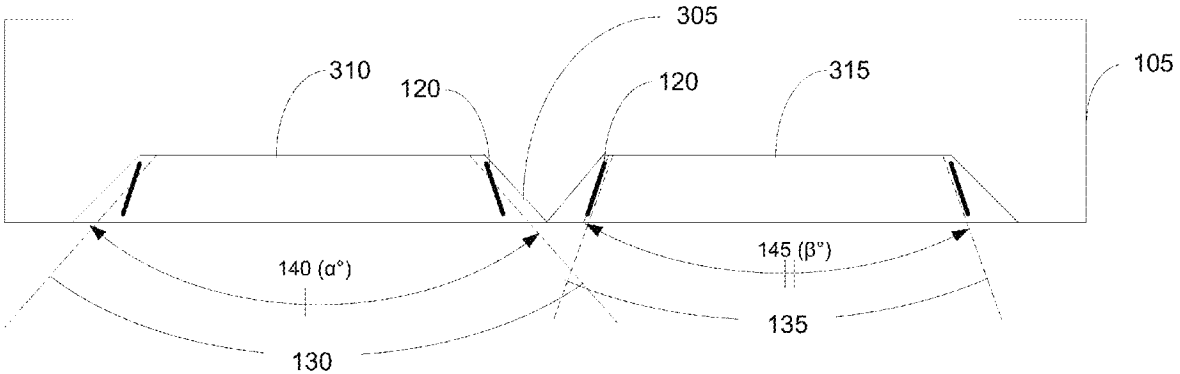
FIG. 4B is a plan view of a single broad beam throw pattern and a single narrow beam throw pattern provided by the lighting fixture depicted in FIG. 3B, according to one illustrated embodiment.

FIG. 4A shows a dual broad beam throw pattern. FIG. 4B shows a single broad beam and a single narrow beam throw pattern. The throw patterns depicted in FIGS. 4A and 4B correspond to the light fixture 300 configurations depicted in FIGS. 3A and 3B, respectively.

The dual broad beam throw pattern in FIG. 4A depicts a light fixture 300 without installed reflective throw pattern adjustment members 125. In such a configuration, the first throw pattern 130 and the second throw pattern 135 are similar. Based upon a the symmetry of reflectors 310 and 315, the subtended angle 140 of each the first throw pattern 130 and the second throw pattern 135 will be similar, having a first value of a° in the example depicted in FIG. 4A. Although not depicted in FIG. 4A, should the reflectors 310 and 315 be asymmetrically configured, the first configurable throw pattern 130 and the second configurable throw pattern 135 may have differing subtended angles.

The single broad beam and a single narrow beam throw pattern in FIG. 4B depicts a configuration where reflective throw pattern adjustment members 125 have been coupled to the portion of reflector 315 providing the second throw pattern 135. The first throw pattern 130, unaffected by the installation of the reflective throw pattern adjustment members 125, retains a broad throw pattern with the relatively wide subtended angle 140 having a first value of α°. The installation of the reflective throw pattern adjustment members 125 proximate the reflector 315 however, reduces the subtended angle 145 of the second throw pattern 135, providing a tighter, more focused throw pattern with a smaller subtended angle 145 having a second value of β°, where α° and β° are different angles.

Although illustrated using a reflector 115 divided using a single reflective member 305 to provide only the first and second reflectors 310, 315, a reflector 115 having any number of configurable throw patterns may be similarly employed by disposing additional reflective members 305 at desired intervals across the reflector 115. For example, the use of two reflective members 305 with coupling features proximate each of the reflectors would provide three separate, distinct, independently configurable throw patterns. Where three or more throw patterns are provided, each may be independently configured after manufacture of the light fixture 100 to have different subtended angles dependent upon the number and location of reflective throw pattern adjustment members 125 coupled to the reflector 115.

Figure 5A:
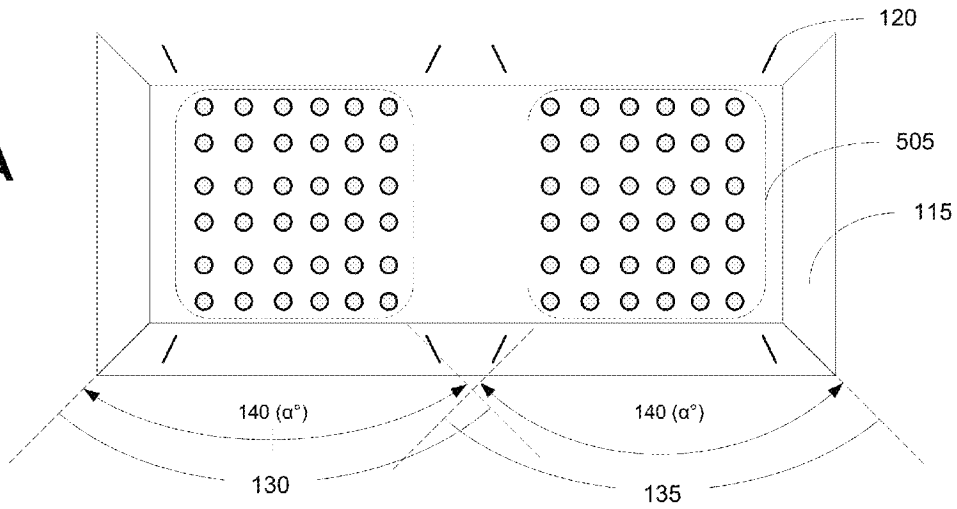
FIG. 5A is an elevation view of a solid state light source disposed within the reflector having configurable first and second throw patterns and a number of coupling features as depicted in FIG. 1A, according to one illustrated embodiment.
Figure 5B:
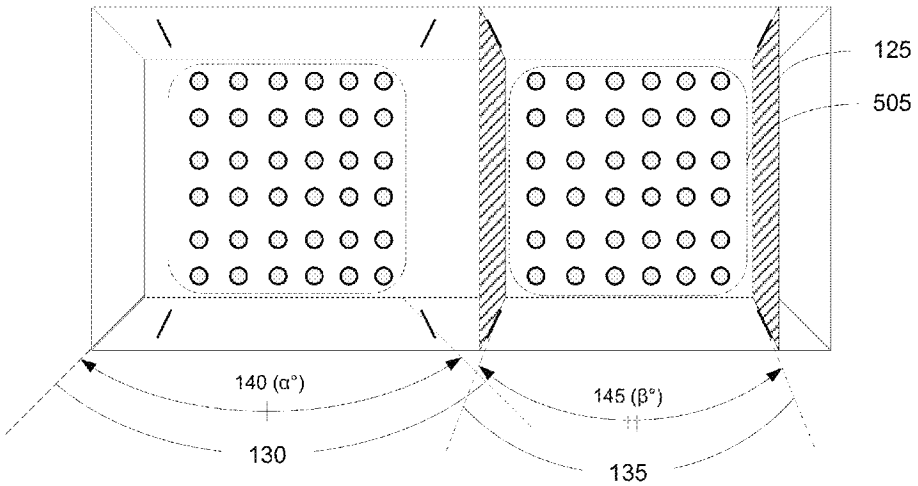
FIG. 5B is an elevation view of a solid state light source disposed within the reflector having configurable first and second throw patterns and including a number of reflective throw pattern adjustment members coupled to a portion of the coupling features as depicted in FIG. 1B, according to one illustrated embodiment.

FIGS. 5A and 5B show example solid state light source 505 useful, for example, in light fixtures 100 and 300 depicted in FIGS. 1A, 1B and 3A, 3B, respectively. The solid state light source 505 can have one or more independent light sources, each comprising one or more individual lights or illuminators 510. The individual lights 510 forming the solid state light source 510 can be arranged or configured in any random or structured pattern, such as the illustrative grid pattern depicted in FIGS. 5A and 5B. The use of one or more patterns of individual lights 510 to form the solid state light source 505 may produce desirable beam characteristics, for example, a region of greater intensity within the beam. In some instances, the solid state light source 505 can be disposed in whole or in part at one or more focal points of the reflector 115. For example, as depicted in FIGS. 5A and 5B, a planar solid state light source 505 may be arranged coplanar with all or a portion of the reflector 115. The solid state light source 505 may be partially or completely sealed against water intrusion, dust intrusion, or both water and dust intrusion.

The solid state light source 505 may be, for example, a light emitting diode (LED) based light source. A non-limiting example solid state light source 505 is the XLM 8030/8040 series LED module manufactured by XICATO®. The output of the solid state light source 505 may vary based upon the available power and/or operational demands placed upon the light fixture 100. The luminous flux of the solid state light source 505 can be about 2000 lumens or greater; about 3000 lumens or greater; about 4000 lumens or greater; or about 5000 lumens or greater. The color value or temperature of the light source may be based at least in part upon the operational demands placed upon the light fixture 100.

The intensity of the solid state light source 505 may be fixed or variable, for example, a variable intensity solid state light source 505 may be useful as a narrow beam throw spotlight since the desired throw distance of the spotlight can vary with the operational demands placed upon the spotlight. Similarly, a variable intensity solid state light source 505 may be useful as a wide beam throw floodlight since environmental conditions such as rain, snow, or water spray may require greater light intensity to provide adequate lighting.

The solid state light source 505 can be mounted in whole or in part within the housing 105. In some instances, the solid state light source 505 is attached directly to the reflector 115. In other instances, the solid state light source 505 is attached to the housing 105 or to a removable cover attachable to the housing 105. Placing the solid state light source 505 on a removable or detachable member improves maintenance access and permits replacement of the solid state light source 505.

Figure 6:
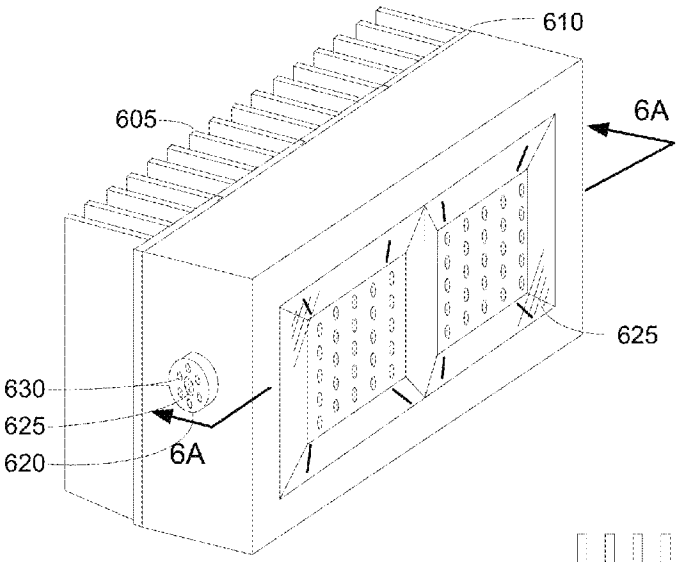
FIG. 6 is an orthogonal view of a lighting fixture including a reflector having two side-by-side reflectors, a heat transfer member, and at least one rotary keyed adjuster, according to one illustrated embodiment.
Figure 6A:
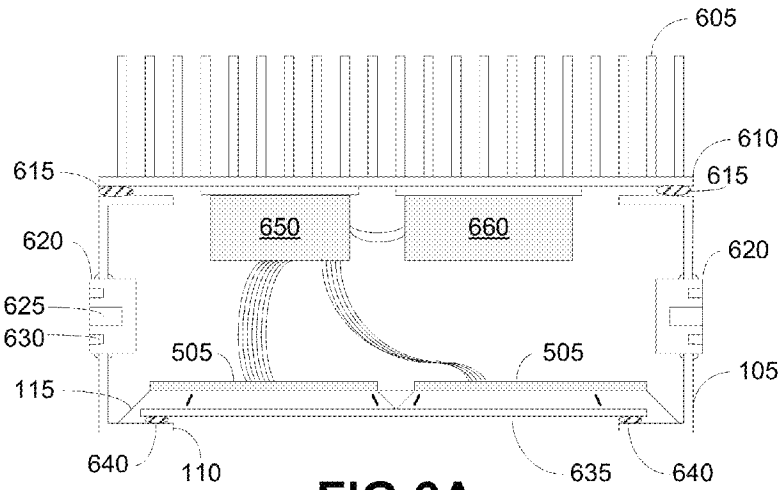
FIG. 6A is a sectional view of the light fixture depicted in FIG. 6, including the thermally conductive material disposed between the heat transfer member and the housing, the thermally conductive sealant material disposed between an at least partially transparent member and the housing, a plurality of rotary keyed adjusters, a power supply and a lighting controller, according to one illustrated embodiment.

FIG. 6 shows a light fixture 600 including a reflector having two side-by-side reflectors 310, 315, a heat transfer member 605, and at least one rotary keyed adjuster 620, according to one illustrated embodiment. FIG. 6A shows the light fixture 600 along sectional line 6A-6A depicting various internal features including an at least partially transparent member 635, and thermally conductive sealant material 640. A solid state light controller 650 and a power converter 660 are depicted as attached to an interior surface of a cover member 610.

Several heat sources including the solid state light controller 650 and power supply 660 are disposed at least partially within the housing 105. Any or all of these elements may individually or collectively generate undesirable levels of heat within the light fixture 600 when in operation. To improve the convective heat transfer properties of the light fixture 600, a heat transfer member 605 is used to convey heat from the interior of the housing 105 to the ambient exterior environment surrounding the housing 105. In at least some instances, the heat transfer member 605 includes an extended surface heat sink such as the finned heat sink depicted in FIG. 6.

The heat transfer member 605 can include or be integral with all or a portion of the cover member 610. The cover member 610 can be attached permanently or temporarily to the housing 105, for example, covering an aperture disposed on a portion of the housing 105. The cover member 610 can be coupled or otherwise attached to the housing 105 using one or more mechanical fasteners (e.g., threaded fasteners such as screw or quarter-turn fasteners), chemical adhesives, or any combination thereof. Where the cover member 610 is a physically distinct component coupled or attached to the housing 105, a thermally conductive sealant material 615 may be disposed at least partially between the housing 105 and the cover member 610. The presence of the thermally conductive sealant material 615 between the housing and the cover member facilitates in the conductive transfer of heat from the housing 105 to the heat transfer member 605 and to the exterior ambient environment surrounding the light fixture 600. The presence of the thermally conductive sealant material 615 between the housing 105 and the cover member 610 also assists in preventing water intrusion or leakage along the joint formed by the intersection of the cover member 610 and housing 105.

In some instances the heat transfer member 605 is an extended surface, finned or pinned, heat sink formed integrally with the cover member 610, for example, an extruded aluminum finned heat sink formed integral with the cover member 610, such as the light fixture 600 depicted in FIGS. 6 and 6A. In other instances, the heat transfer member 605 is a physically distinct structure that is physically and thermally coupled to the cover member 610 via a thermally conductive mechanical coupling (e.g., mechanical fasteners used with a thermally conductive sealant material) or a thermally fused coupling (e.g., a thermally conductive metallic weld between the heat transfer member 605 and the cover member 610).

The cover member 610 may be used to provide a mounting surface for the solid state light source 505, the solid state light controller 650, the power converter 660, or any combination thereof. Some or all of the components physically coupled to the cover member 610 may also be thermally coupled to the cover member 610 to facilitate the flow of heat from the components to the heat transfer member 605 coupled to the cover member 610. The mating surfaces of the cover member 610, the surfaces that come into contact with and form the joint between the cover member 610 and the housing 105 may be machined or otherwise mechanically or chemically finished to provide a relatively smooth sealing surface.

The thermally conductive sealant material 615 includes any material permitting the flow of heat between two surfaces disposed on either side of the material. A silicon or polyurethane carrier impregnated with thermally conductive particles such as aluminum particles provides an example thermally conductive sealant material 615. Example polyurethane carriers include 4200 Series Polyurethane Marine Sealant and 5200 Series Polyurethane Marine Sealant both manufactured by 3M® Corporation. The thermally conductive particles suspended within the carrier are selected at least in part, based upon minimizing the likelihood of electrolysis or corrosion of the adjoining surfaces (i.e., the housing 105 and the cover member 610).

One or more keyed rotary adjusters 620 are disposed in, on, or about the housing 105. The keyed rotary adjusters 620 are used to attach or otherwise affix the light fixture 600 to a mounting member which can then be attached to an external structure, for example, a stationary or shipboard structure.

Each of the rotary keyed adjusters 620 includes a central cavity 625 to accept the insertion of a threaded or smooth shaft physically supporting the light fixture 600 and a plurality of peripheral cavities 630 to accept the insertion of a key member to fix the position of the light fixture 600 with respect to the mounting member. Both the central cavity 625 and the plurality of peripheral cavities 630 can be of any size or geometric configuration suitable for mounting and aiming or otherwise directing the first and second configurable throw patterns 130, 135 generated by the light fixture 600. The central cavity 625 and the peripheral cavities 630 only partially penetrate through the keyed rotary adjuster 620 body to prevent water from passing through the keyed rotary adjuster cavities 625, 630 into the housing 105. The central cavity 625 and all or a portion of the peripheral cavities 630 can be internally smooth finished or internally threaded to accommodate the insertion of a threaded fastener such as a screw or bolt.

An example keyed rotary adjuster 620 is about 1.50 inches in diameter and about 1.25 inches tall. An example central cavity 625 has a diameter of about 0.375 inches a depth of about 1.00 inch, and in some instances can be threaded to accommodate the insertion of a threaded shaft, for example, using a X16 tap. The plurality of peripheral cavities 630 can be equally or unequally angularly spaced at about 0.50 inches center to center around the central cavity 625. For example, a total of eight (8) peripheral cavities can be equally angularly spaced at about 45° intervals about the central cavity, each of the peripheral cavities having a diameter of about 0.125 inches and a depth of about 0.25 inches.

Any or all of the keyed rotary adjusters 620 are disposed partially or completely outside the housing 105. In some embodiments, the keyed rotary adjusters 620 can be mounted entirely on the exterior surface of the housing 105, for example, by externally fillet welding about the perimeter of the keyed rotary adjuster 620 and the housing 105. In other embodiments, the keyed rotary adjuster 620 partially extends into the interior of the housing 105, for example, by insertion through an appropriate sized aperture disposed in the housing 105. Where the keyed rotary adjuster 620 partially extends into the interior of the housing 105, the adjuster can be attached to the housing an interior fillet weld, an exterior fillet weld, or both interior and exterior fillet weld (i.e., back-welded into the housing 105). Regardless of the manner used to secure the keyed rotary adjusters 620 to the housing 105, the central cavity 625 and the peripheral cavities 630 remain accessible from the exterior of the housing 105.

An at least partially transparent member 635 at least partially fills the opening 110 in the housing 105. The at least partially transparent member 635 permits the passage of the first configurable throw pattern 130 and the second configurable throw pattern 135 from the reflector 115 to the ambient exterior environment surrounding the light fixture 600. The thickness, size, shape, and configuration of the at least partially transparent member 635 is based in whole or in part upon the geometry of the opening 110, for example, a larger opening 110 may require the use of a thicker at least partially transparent member 635 than a smaller opening 110. The at least partially transparent member 635 can include a member composed of a glass material, a polymeric material, or a laminated material comprised of either or both glass and/or polymeric materials. An example material for the at least partially transparent member 635 is an ultraviolet (UV) tempered glass.

The at least partially transparent member 635 may be partially or completely transparent or translucent. The at least partially transparent member 635 may have a tint or other coloration to provide illumination in any desired color from the light fixture 600.

In some instances, the at least partially transparent member 635 is coupled or otherwise attached to the housing 105 after the manufacture of the light fixture 600. For example, the light fixture 600 may be shipped without the at least partially transparent member 635 and any reflective throw pattern adjustment members 125 installed. Subsequent to manufacture, one or more reflective throw pattern adjustment members 125 are installed, for example, based upon the requirements of the user. Subsequent to the installation of the one or more reflective throw pattern adjustment members 125, the at least partially transparent member 635 is installed to protect the housing 105 against water intrusion. Thus to provide a configurable light fixture 600 easily tailored to operational requirements, either or both the one or more reflective throw pattern adjustment members 125 and the at least partially transparent member 635 are installable subsequent to the manufacture of the light fixture 600.

To minimize the likelihood of water intrusion, and to thermally couple the at least partially transparent member 635 to the housing, a thermally conductive sealant material 640 can be disposed at least partially about the perimeter of and between the at least partially transparent member 635 and the housing 105. Thermally coupling the at least partially transparent member 635 to the housing 105 allows conductive heat flow from the housing to the at least partially transparent member 635. Heating the at least partially transparent member 635 minimizes the likelihood of fogging or formation of condensation on the surface of the at least partially transparent member 635.

The thermally conductive sealant material 640 can be the same as or different from the thermally conductive sealant material 615 disposed between the cover member 615 and the housing 105. The thermally conductive sealant material 640 includes thermally conductive particles dispersed in a carrier, for example, a polyurethane sealant such as 4200 Series Polyurethane Marine Sealant and 5200 Series Polyurethane Marine Sealant both manufactured by 3M® Corporation. In some instances, the thermally conductive sealant material 640 is applied after manufacture of the light fixture 600, prior to the installation of the at least partially transparent member 635.

A light controller 650 coupled to each of the solid state light sources 505 provides the proper current, voltage, and power delivery to the solid state light sources 505. The light controller 650 can be mounted or otherwise attached or coupled to an interior surface of the housing 105, for example, the light controller 650 can be attached to the cover member 610 as depicted in FIGS. 6 and 6A. Example light controllers 650 include the Xitanium LEDINTA1050C140DO and LEDINTA700C140F3O lighting controllers manufactured by Philips Electronics® or the LF1048-88-00700 lighting controller manufactured by Mag-Tech Industries®.

In some instances, a power converter 660 may be coupled to some or all of the light controllers 650 to provide power corresponding to the input specifications of the light controller 650. For example, the power converter 660 can adjust the voltage and/or frequency of the incoming alternating current (AC) power as needed to satisfy the power requirements of the light controller 650. The power converter 660 can be mounted or otherwise attached or coupled to an interior surface of the housing 105, for example, the light controller 650 can be attached to the cover member 610 as depicted in FIGS. 6 and 6A.

Figure 7A:
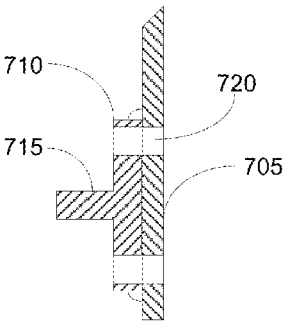
FIG. 7A is a sectional view of the complimentary keyed rotary adjuster on the mounting member, including a shaft and peripheral cavities to accept the insertion of a key member, according to one illustrated embodiment.
Figure 7B:
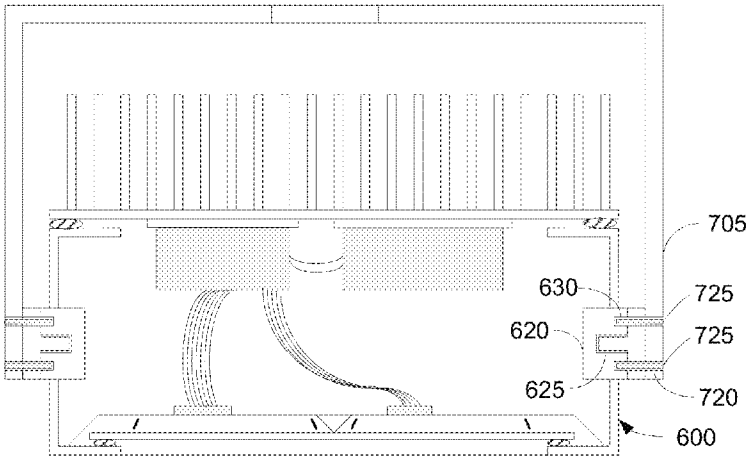
FIG. 7B is a sectional plan view of the mounting member coupled to the light fixture depicted in FIG. 7, according to one illustrated embodiment.
Figure 7:
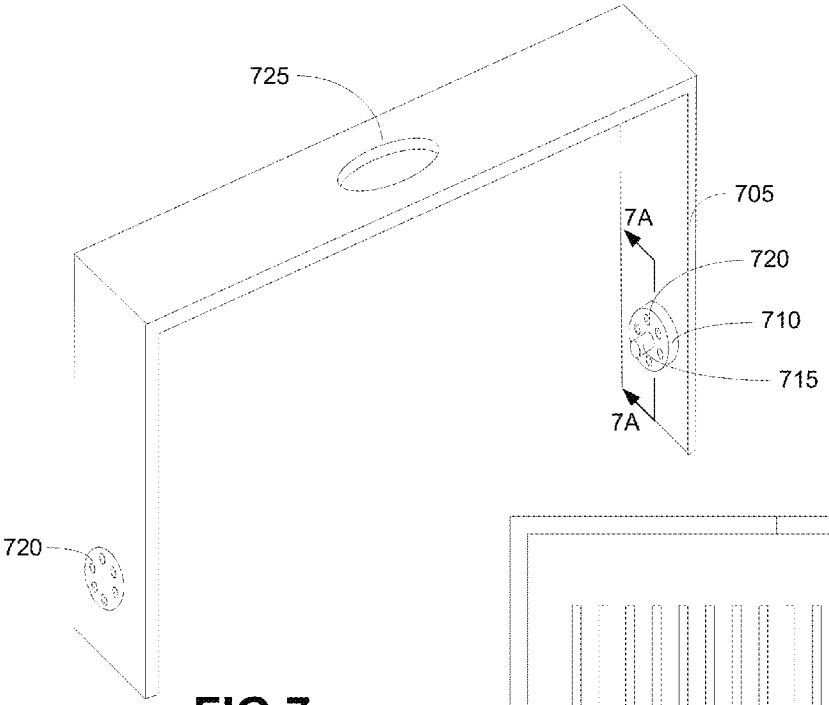
FIG. 7 is an orthogonal view of a mounting member complimentary with and couplable to the plurality of keyed rotary adjusters on the lighting fixture, according to one illustrated embodiment.

FIG. 7 shows a mounting member 705 couplable to the plurality of keyed rotary adjusters 620 on the lighting fixture 600. The sectional elevation view depicted in FIG. 7A provides a view of the complimentary keyed rotary adjuster 710 on the mounting member 705. FIG. 7B shows the mounting member 705 coupled to the light fixture 600 as depicted in FIG. 6. The light fixture 600 can be coupled to a mounting member 705 such as the illustrative swivel yoke mounting member 705 depicted in FIG. 7. The mounting member 705 can include a number of complimentary keyed rotary adjusters 710 to couple with or otherwise engage the keyed rotary adjusters 620 disposed on the housing 105. For the example arrangement depicted in FIGS. 7 and 7B, the mounting member 705 contains two complimentary keyed rotary adjusters 710 to engage the two lateral keyed rotary adjusters 620 disposed on the housing 105.

The mounting member 705 can include any structure suitable for engaging at least one of the keyed rotary adjusters 620 disposed on the light fixture 600. In some instances, the mounting member can include a "U"-shaped member having a complimentary keyed rotary adjuster 710 on each of the parallel legs as depicted in FIGS. 7 and 7B. Any structurally sound metallic or non-metallic material can be used for the mounting member, however ambient environmental conditions may limit the choice to a corrosion resistant material such as ASTM 316 or 316L Stainless Steel.

The complimentary keyed rotary adjuster 710 includes a central shaft 715 surrounded by one or more peripheral apertures 720. The peripheral apertures 720 extend through both the complimentary keyed rotary adjuster 710 and the mounting member 705 to accommodate the passage of one or more key members 725 through the peripheral aperture 720 into at least one of the peripheral cavities 625 in the keyed rotary adjuster 620. The passage of a key member 725 through the peripheral aperture 720 into at least one of the peripheral cavities 625 in the keyed rotary adjuster 620 fixes or otherwise locks the rotation of the light fixture 600 about the shaft 710.

While an example complimentary keyed rotary adjuster 710 is depicted as having a solid center shaft 715, one or more replacement elements not depicted in FIGS. 7, 7A, and 7B can be substituted for the shaft 710. For example, the shaft 710 can be replaced with an internally smooth or threaded aperture extending through both the complimentary keyed rotary adjuster 710 and the mounting member 705. An appropriately sized bolt can then be passed through the mounting member 705 and the complimentary keyed rotary adjuster 710, and threaded into the keyed rotary adjuster 620.

The complimentary keyed rotary adjuster 710 can be attached or otherwise fastened to the mounting member 705 using mechanical fasteners or by thermal fusion. Some or all of the peripheral apertures 720 in the keyed rotary adjuster 710 can extend through the mounting member 705 to permit the passage of the key member 725. In some instances all or a portion of the peripheral apertures 720 can be internally smooth finished. In other instances all or a portion of the peripheral apertures 720 can be internally (i.e. female) threaded to accommodate the insertion of a threaded key member 725 such as a screw or bolt.

An example complimentary keyed rotary adjuster 710 includes a shaft 715 having a length of about 0.9375 inches and a diameter of about 0.3125 inches. Each of the peripheral apertures 720 has a diameter of at least 0.25 inches to accommodate the passage of a key member approximately 0.25 inches in diameter to the peripheral cavities 630 disposed in the keyed rotary adjuster 620.

Another example complimentary keyed rotary adjuster 710 includes a central aperture instead of a shaft 710. The central aperture has a diameter of about 0.4375 inches to accommodate the passage of a 0.375 inch diameter bolt through the aperture and into the central cavity 625. Where the keyed rotary adjuster central cavity 625 is internally threaded, the light fixture 600 can be secured by tightening the bolt within the keyed rotary adjuster 620. Each of the peripheral apertures 720 has a diameter of at least 0.25 inches to accommodate the passage of a key member approximately 0.25 inches in diameter to the peripheral cavities 630 disposed in the keyed rotary adjuster 620.

FIG. 7B depicts a light fixture 600 coupled to a mounting member 705 using two laterally opposed keyed rotary adjusters 620 disposed on opposite sides of the light fixture 600. A plurality of key members 725 pass through the peripheral apertures 720 and reside within the keyed rotary adjuster peripheral cavities 630. The installation of the key members 725 fixes the rotation of the light fixture 600 about the axis defined by the shafts 710.

A mounting fixture 725 is disposed in, on, or about the mounting member 705. The mounting fixture 725 permits the attachment of the mounting member 705 to an external structure, for example, a shipboard external structure. Attaching the mounting member 705 to an external structure via the mounting fixture 725 provides a stable, secure attachment; fixing the rotation of the light fixture 600 with respect to the mounting member 705 by inserting one or more key members 725 into the peripheral cavities in the keyed adjustment member 620 can provide a desirable stable, secure mounting of the light fixture 600 with respect to the external structure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including but not limited to U.S. Provisional Application Ser. No. 61/551,296, are incorporated herein by reference, in their entirety. Aspects of the embodiments can be modified, if necessary to employ concepts of the various patents, applications and publications to provide yet further embodiments.

For example, while generally discussed in terms of a marine environment, the light fixtures described herein may be employed in a large variety of other environments or applications. For instance, the light fixtures may be employed in freight yards, warehouses, rail yards, factories or any other environment where a configurable throw pattern and/or environmental protection are desired.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A light fixture, comprising:

a housing having an interior separated by the housing from an exterior ambient environment, the housing having at least one opening between the interior and the exterior ambient environment; and at least one reflector at least partially received by the housing and which has a first and a second configurable throw pattern that extends outwardly from the at least one opening, the configurable throw patterns having respective ones of at least one subtended angle, the at least one reflector comprises a first reflector having four reflective sides which include a first pair of opposed reflective sides and a second pair of opposed reflective sides, the reflective sides of each of the first and the second pairs of reflective sides angled outwardly with respect to one another from the interior of the housing toward the exterior ambient environment, the first reflector having a number of coupling features to selectively install, after manufacture of the light fixture, at least one reflective throw pattern adjustment member, the number of coupling features includes a first pair of slots in the first pair of opposed reflective sides and a second pair of slots in respective ones of the first pair of opposed reflective sides, the second pair of slots spaced laterally across the first reflector from the first pair of slots, the first and the second pair of slots each sized and dimensioned to securely and removably receive one of the at least one reflective throw pattern adjustment member, the first pair of slots disposed at a different angle than the second pair slots measured with respect to the first reflector, and a first one of the subtended angles of the first configurable throw pattern has a first value when the reflective throw pattern adjustment member is not installed and the first one of the subtended angles of the first configurable throw pattern has a second value after the reflective throw pattern adjustment member is installed, the second value of the first one of the subtended angles different from the first value of the first one of the subtended angles.

2. The light fixture of claim 1 wherein a first one of the subtended angles of the second configurable throw pattern has a first value when the reflective throw pattern adjustment member is not installed and the first one of the subtended angles of the second configurable throw pattern has a second value after the reflective throw pattern adjustment member is installed, the second value of the first one of the subtended angles different from the first value of the first one of the subtended angles.

3. The light fixture of claim 1 wherein a first one of the subtended angles of the second configurable throw pattern has a first value when the reflective throw pattern adjustment member is not installed, the first value of the first one of the subtended angles of the second configurable throw pattern approximately the same as the first value of the first one of the subtended angles of the first configurable throw pattern.

4. The light fixture of claim 1 wherein the at least one reflector includes the first reflector and a second reflector mounted in a side by side relationship to the housing, and further comprising:

a first solid state light source positioned with respect to the first reflector such that the first reflector reflects at least a portion of the light emitted by the first solid state light source in the first configurable throw pattern; and a second solid state light source positioned with respect to the second reflector such that the second reflector reflects at least a portion of the light emitted by the second solid state light source in the second configurable throw pattern.

5. The light fixture of claim 4 wherein the second reflector has at least four reflective sides which include a first pair of opposed reflective sides and a second pair of opposed reflective sides, the reflective sides of each of the first and the second pairs of reflective sides angled outwardly with respect to one another from the interior of the housing toward the exterior ambient environment.

6. The light fixture of claim 5 wherein the at least one reflective throw pattern adjustment member includes at least a first and a second reflective throw pattern adjustment member and the number of coupling features includes a first pair of slots in respective ones of the first pair of opposed reflective sides of the first and second reflectors and a second pair of slots in respective ones of the first pair of opposed reflective sides of the first and second reflectors, the second pair of slots spaced laterally across the first reflector from the first pair of slots, the first and the second pair of slots sized and dimensioned to securedly receive respective ones of the first and the second reflective throw pattern adjustment members.

7. The light fixture of claim 6 wherein the slots in the first one of the reflective sides of the first opposed pair of reflective sides are angled outwardly with respect to one another from the interior of the housing toward the exterior ambient environment, and the slots in the first one of the reflective sides of the second opposed pair of reflective sides are angled outwardly with respect to one another from the interior of the housing toward the exterior ambient environment.

8. The light fixture of claim 7 wherein an angle between the slots in the first one of the reflective sides of the first pair of opposed reflective sides is different than an angle between the slots in the first one of the reflective sides of the second pair of opposed reflective sides.

9. The light fixture of claim 1, further comprising at least one keyed rotary adjuster coupled to the housing to rotate the housing about at least one axis, the keyed rotary adjuster including a central cavity to accept the insertion of a shaft, surrounded by a plurality of peripheral cavities to accept the insertion of a key member to fix the housing at a fixed angle of rotation about the shaft.

10. The light fixture of claim 9, wherein the housing includes an exterior surface and the at least one keyed rotary adjuster is affixed to the exterior surface of the housing.

11. The light fixture of claim 9, wherein the housing includes an interior surface and the at least one keyed rotary adjuster is at least partially affixed to the interior surface of the housing and is accessible from outside of the housing.

12. The light fixture of claim 1, further comprising a transparent member received into the opening of the housing, the transparent member coupled at least in part to the housing by a thermally conductive sealant material disposed at least partially between the transparent member and the housing to seal the opening and conductively transfer heat between the housing and the transparent member.

13. The light fixture of claim 1, further comprising a heat transfer member at least partially coupled to the housing at least in part by a thermally conductive material disposed at least partially between the heat transfer member and the housing to conductively transfer heat from the housing to the heat transfer member.

* * * * *